US007659865B2

(12) United States Patent
Kreitzberg et al.

(10) Patent No.: US 7,659,865 B2
(45) Date of Patent: Feb. 9, 2010

(54) ADJUSTABLE FAST SET ANTENNA FRAME

(75) Inventors: Michael A. Kreitzberg, Salem, OR (US); David B. Vaughn, Salem, OR (US); Kevin A. Raddatz, Keizer, OR (US)

(73) Assignee: Steelhead Metal & Fab, LLC, Salem, OR (US)

( * ) Notice: Subject to any disclaimer, the term of this patent is extended or adjusted under 35 U.S.C. 154(b) by 124 days.

(21) Appl. No.: 12/079,176

(22) Filed: Mar. 24, 2008

(65) Prior Publication Data

US 2008/0278402 A1 Nov. 13, 2008

Related U.S. Application Data

(60) Provisional application No. 60/917,661, filed on May 13, 2007.

(51) Int. Cl.
*H01Q 1/08* (2006.01)
*H01Q 1/12* (2006.01)

(52) U.S. Cl. ..... 343/880; 343/890

(58) Field of Classification Search ..... 343/878, 343/880, 881, 890, 891; 52/79.5, 633, 645
See application file for complete search history.

(56) References Cited

U.S. PATENT DOCUMENTS

| | | | | |
|---|---|---|---|---|
| 5,920,291 | A | 7/1999 | Bosley | |
| 5,971,345 | A * | 10/1999 | Khalaf | 248/512 |
| 7,086,207 | B2 | 8/2006 | Piburn et al. | |
| 7,113,145 | B1 | 9/2006 | Noblei | |
| 7,466,286 | B2 * | 12/2008 | Chapman | 343/890 |
| 2006/0279472 | A1 * | 12/2006 | Piburn et al. | 343/890 |
| 2007/0261355 | A1 * | 11/2007 | Carlisle et al. | 52/633 |

* cited by examiner

*Primary Examiner*—Hoang V Nguyen
(74) *Attorney, Agent, or Firm*—Crowell Ing, LLP; Carl Crowell; Nye Wang

(57) ABSTRACT

This invention pertains to antenna sector frame that can be more easily installed. The frame is comprised of a support frame having a first vertical end, a second vertical end, an upper horizontal end, and a lower horizontal end. The first vertical end of the support frame may be connected to at least one mounting bracket and the second vertical end of said support frame may be connected to at least one curved T-housing, wherein the lower horizontal end of the support frame is connected to at least one storage base. The face frames comprises of a first vertical end and a second vertical end, wherein the first vertical end may be attached to the curved T-housing.

6 Claims, 7 Drawing Sheets

ADJUSTABLE FAST SET ANTENNA FRAME

CROSS-REFERENCE TO RELATED APPLICATIONS

This application contains disclosure from and claims the benefit under Title 35, United States Code, §119(e) of the following U.S. Provisional Application: U.S. Provisional Application Ser. No. 60/917,661 Filed May 13, 2007 entitled ADJUSTABLE FAST SET ANTENNA FRAME.

BACKGROUND OF THE INVENTION

1. Field of Invention

The present invention relates to sector frames for attaching of antennas onto utility power transmission structures or other vertical or of like kind structures.

2. Background of the Invention

It has been common practice in the telecommunication industry to bypass the cost and difficulties of constructing antenna towers by attaching antennas to preexisting power towers or structures of similar utility. This embodiment pertains to the mounting frame used to attach such antennas to tower structure in a safe, efficient and secure way.

The process of adding antennas to a tower structure requires a stable sector frame that can be securely attached, and withstand the weight of the antenna. Therefore, the sector frames themselves are often extremely heavy and bulky. Previous solutions included heavy individual beams forming a completed frame that required time stacking assembly on the floor before it can be attached to the tower. The obvious disadvantage to assembling the sector frame away from the tower is that it will require a great deal of effort to lift the finished produce up the tower. Furthermore, lifting and attaching a sector frame that can exceed twelve feet in width to an elevated structure can be overly challenging, especially if the tower is also surround by preexisting power or telephone cables.

The prior art tried to solve this problem by allowing the entire sector frame to be folded so the size of the frame can be more maneuverable during installation and then unfolded after its attachment to the tower. However, this still required the installer to pull and install the entire antenna frame at once to the top of a tower. The problem regarding weight and maneuverability remains unsolved.

The adjustable fast set frame solves this problem by breaking up the frame into three manageable preassembled pieces, thus allowing installers the ability to move and install the frame onto a tower one section at a time.

SUMMARY

In the preferred embodiment the Fast Set Antenna Frame comes in three preassembled frames comprised of two face frames and a support frame. The installation of the antenna frame to the tower may be accomplished by first installing the support frame onto the tower by using mounting brackets. The angle of the support frame in regards to the tower can be adjusted by altering the position of the bolts used to connect the support frame and the mounting brackets. Once the support frame is attached to the tower, installers can pull up and install the face frames individually. During the installing of the face frames, installers can stand on the attached storage base for support and positioning. Once the two face frames are attached to the support frame by the curved T-housing, the angle of the face frames in regard to the support frame can be adjusted by maneuvering the bolt that attaches the curved T-housing to the support frame. The antenna mounting pipes can be installed onto the face frame before or after the attachment of the face frames to the support frame. The Stiff Arm kits can be attached to the tower for further structural support.

This embodiment bypasses the need to lift a completely assembled antenna frame that can be upwards of twelve feet wide and eight hundred pound up an elevated tower by dividing the antenna frame into three easy to manage components. This embodiment allows flexibility of the position of the antenna in accordance to the vertical tower and horizontal support frame and can be assembled in less time and in safer manner than the prior art.

BRIEF DESCRIPTION OF THE DRAWINGS

The above description and other objects, advantages, and features of the present embodiment will be more fully understood and appreciated by reference to the specification and accompanying drawings, wherein.

DETAILED DISCUSSION OF THE PREFERRED EMBODIMENT

Figure 1:
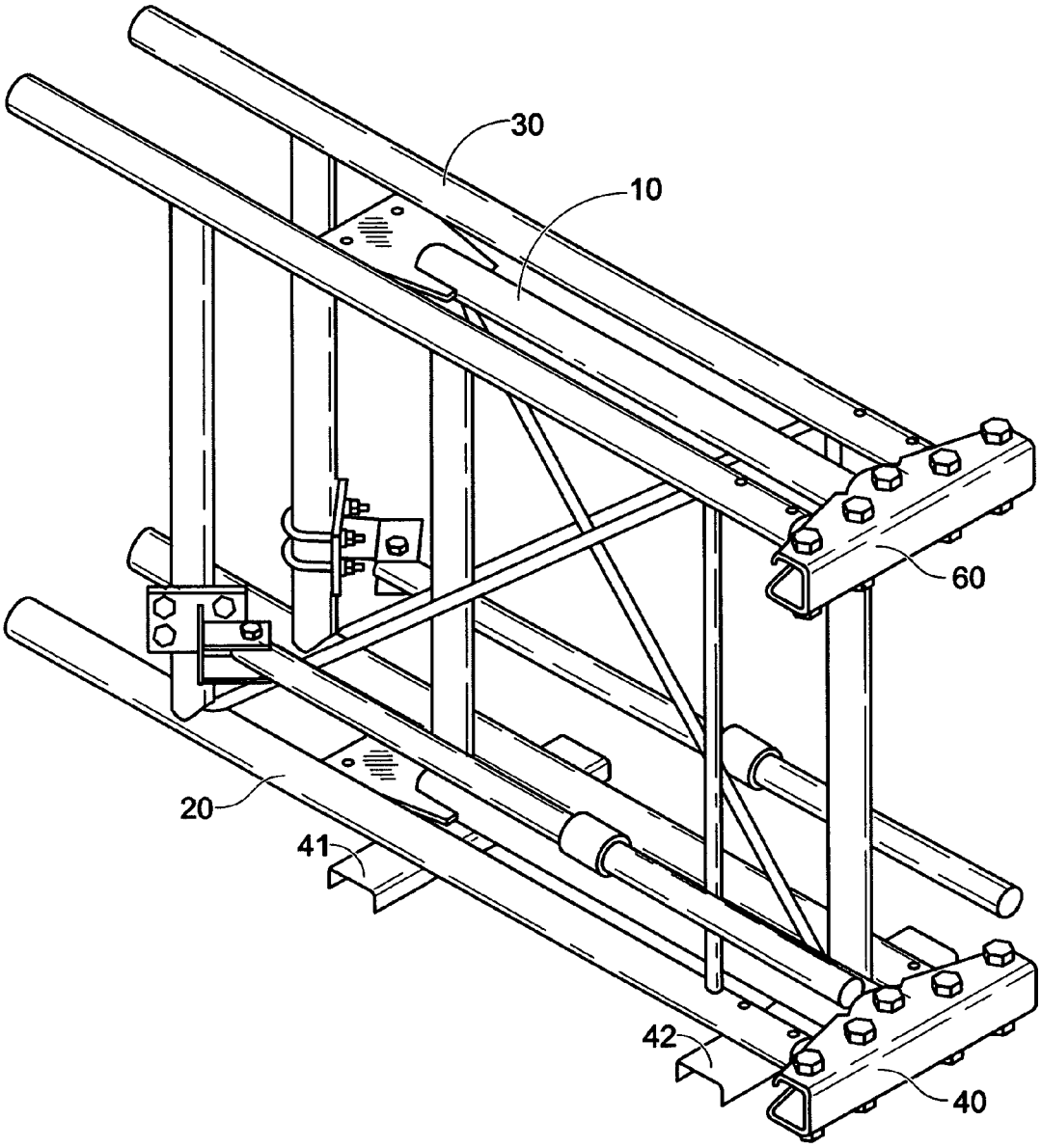
FIG. 1 shows an isometric view of the Fast Set Antenna Frame during its storage and shipping state in accordance with one embodiment.

FIG. 1 depicts an isometric view of the shipping and storage state of the Fast Set Antenna Frame, according to an embodiment.

During the storage and shipping stage of the Fast Set Antenna Frame, the three preassembled frames, including the support frame 10, face frame 20, and face frame 30, rest in the groves of the storage base 41 and 42. This storage system improves on the prior art by allowing the Fast Set Antenna Frame to be stored and shipped in more of a compact form, thus reducing the storage space needed and the resource required to move the embodiment.

Furthermore, as seen in this view, the two face frames are not attached to the support frame during storage. Unlike the prior arts which have the face frames pre-attached and folded, the Fast Set Antenna Frame comes in three unattached frames so that during the installation phase, the installers can install one frame at a time. This allows the installer to better manage the weight and size of the antenna frame.

The preassembled support frame 10, face frame 20, and face frame 30 can be attached and assembled on the tower one at a time (see FIG. 9), thus shortening the installation process.

Figure 2:
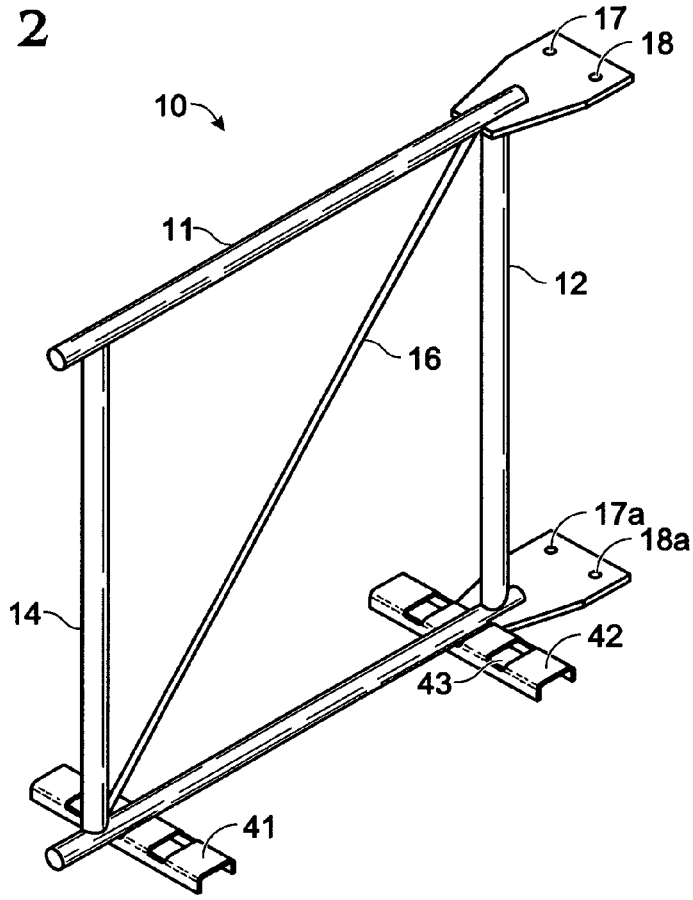
FIG. 2 shows an isometric view of the support frame with two attached storage bases in accordance with one embodiment.

FIG. 2 shows an isometric view of the support frame 10 with storage base 41, 42. Support frame 10 consists of two horizontal frames 11, 13 attached by two vertical frames 12,14 and traversed by frame 16. The support frame consists of two sides, whereby the first side can be attached to the tower and second side can be attached to face panel 20 and face panel 30. The storage base 41 and storage base 42 are preferably fixed onto the lower horizontal frame 13.

The support frame can be individually pulled up to the desired point of the tower and installed onto the tower. This allows installers the flexibility to attach the support frame to the tower instead of the whole antenna frame which may be very heavy and bulky.

In the preferred embodiment, all the member frames including 11, 12, 13, and 14 are cylindrical in shape so as to provide better wind resistance.

Figure 3:
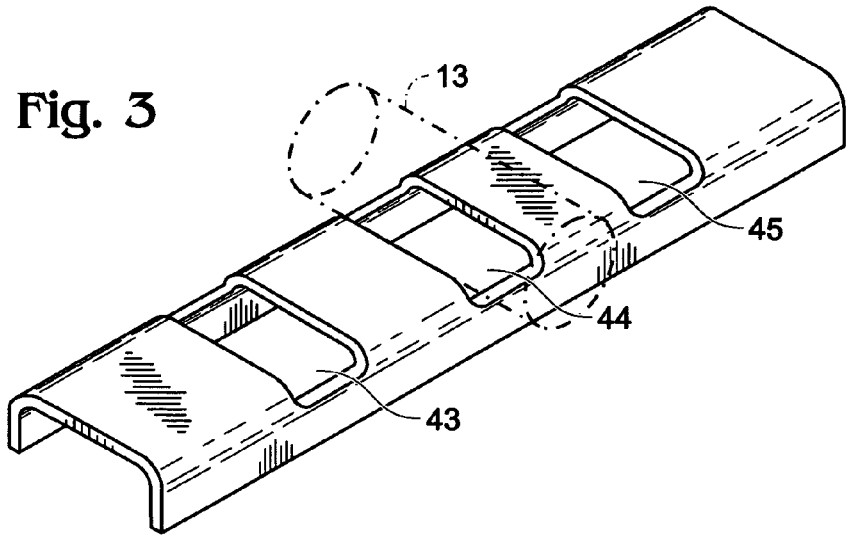
FIG. 3 shows an isometric view of the storage base in accordance with one embodiment.

FIG. 3 shows an isometric view of one of the two storage base 41, 42. Storage groves 43, 44, 45 are used to secure in places face frame 20, support frame 10, and face frame 30. The lower horizontal frame 13 of support frame 10 is preferably fixed to grove 44 of the storage base. The fixed storage base has an added advantage as foot holds during the installation process. The process of installing anything on the top of an elevated tower can be difficult and the storage base which can act as a foot hold may provide a support structure for installers to stand on during the installation and adjustment of the face frames.

Figure 4A:
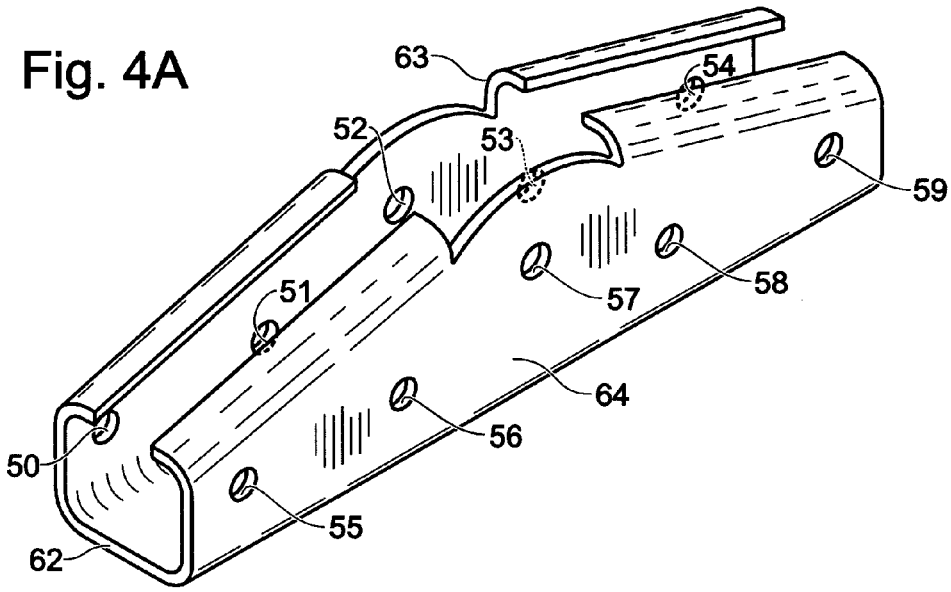
FIG. 4*a* shows an isometric view of the curved T-housing in accordance with one embodiment.

FIG. 4*a* shows an isometric view of the curved T-housing 40 and 60 used to connect both face frames to the support frame. The curved T-housing has an upper side 63, lower side 64, back 62, and an open curved front side 61. The middle section of the said open front side is not curved as to allow the installation of support frame 10.

Figure 4B:
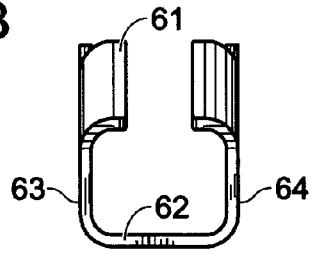
FIG. 4*b* shows a side view of the curved T-housing in accordance with one embodiment.

FIG. 4*b* shows a side view of the curved T-housing. The concaved curved edges in front side 61 provide guidance and support for the face frames and prevent the folding of the face frames both inward and outward.

Figure 4C:
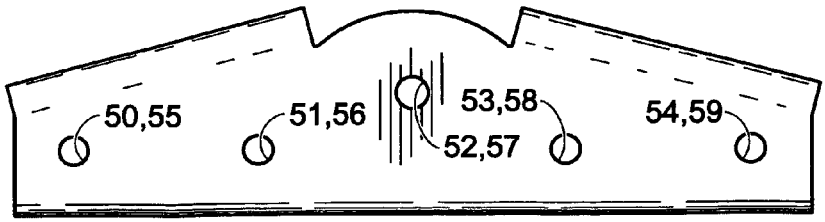
FIG. 4*c* shows a top view of the curved T-housing in accordance with one embodiment.

FIG. 4*c* shows a top view of the curved T-housing. The topside 63 consists of mounting holes 50, mounting holes 51, mounting holes 52, mounting holes 53, and mounting holes 54. The bottom side 64 consists of mounting holes 55, mounting holes 56, mounting holes 58, and mounting holes 57.

Figure 5:
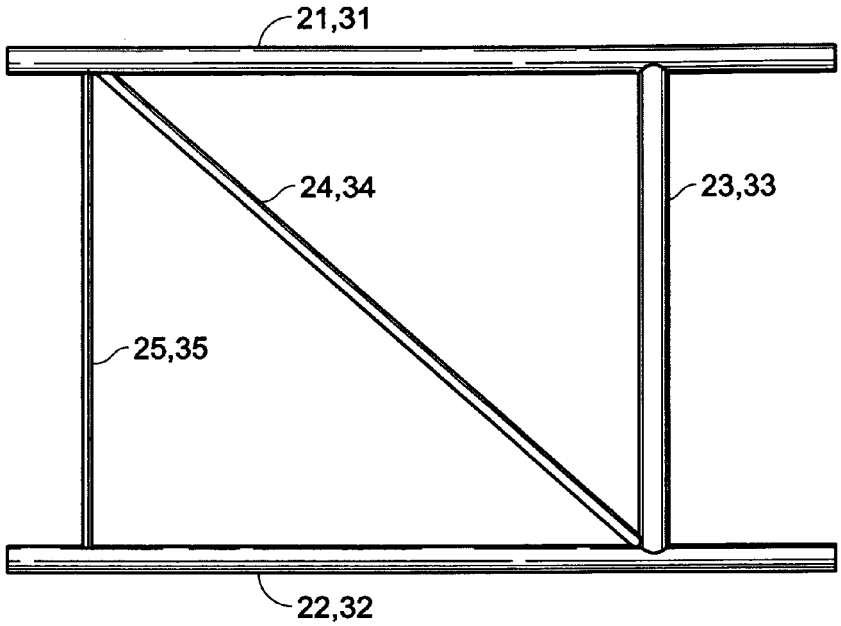
FIG. 5 shows a front view of either of the two identical face frames in accordance with one embodiment.

FIG. 5 shows the front view of one of two attachable face frames 20 and 30. The face frames are comprised of an upper horizontal frame 21 and lower horizontal frame 22 attached by vertical frame 32, vertical frame 25, and diagonal frame 24. The face frame containing horizontal frames 21, 22 has two sides, wherein the first side closest to vertical frame 25 is connected to the curved T-housing as seen in FIG. 6 and the second side closest to vertical frame 23 can be used to support antenna mounting pipes 101 and 103 (see FIG. 8).

Figure 9:
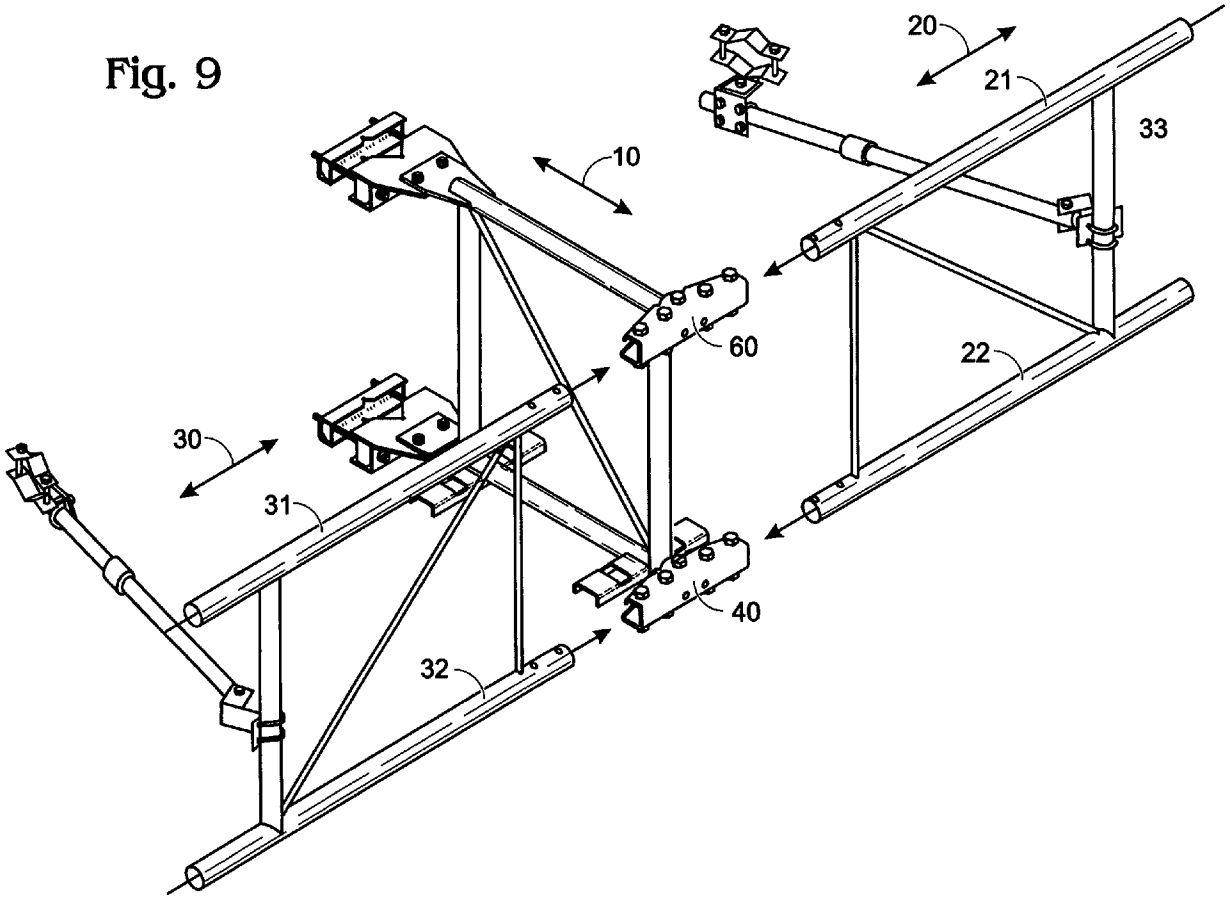
FIG. 9 shows an isometric view of the assembly process to connect the face frames to the support frame in accordance with one embodiment.

Because the face frames come preassembled but unattached to the main support frame 10, installers can first install the support frame on the tower and then stand on the storage base and pull up and install one face frame at a time (see FIG. 9).

Once again, in the preferred embodiment the individual member frames 21-25 and 31-35 are cylindrical in shape to provide better wind resistance.

Figure 6:
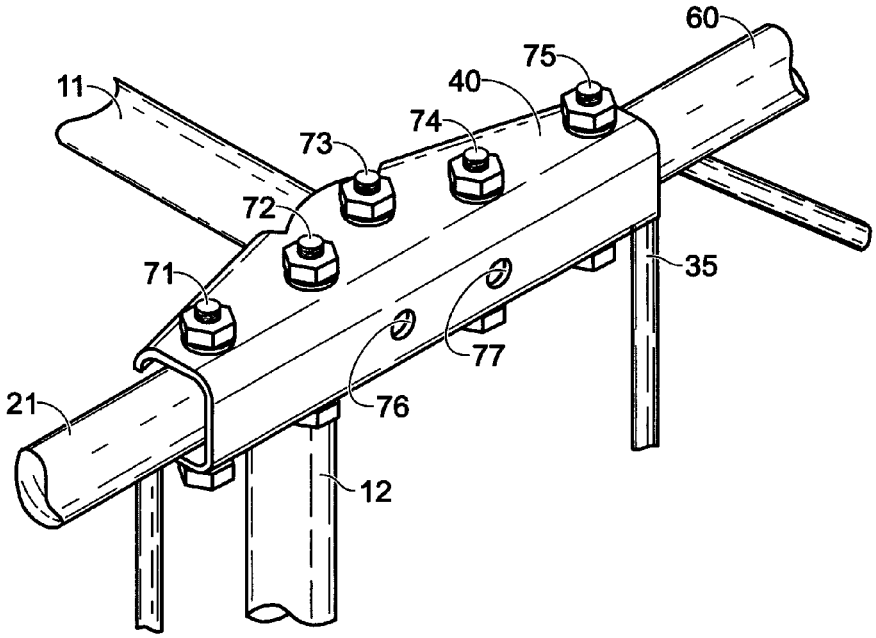
FIG. 6 shows an isometric view of the support frame and the two face frames connected by the curved T-housing in accordance with one embodiment.

FIG. 6 shows an isometric view of the curved T-housing 60 joining the support frame to the two face frames. The second side of upper horizontal frame 11 on the support frame 10 is attached by bolt 73 through mounting holes 52 and 57. The first side of upper horizontal frame 21 on face frame 20 is attached by bolt 71, which goes through mounting holes 50, 55, and bolt 72 which runs through mounting holes 51 and 61. The first side of upper horizontal frame 31 of face frame 30 is attached by bolt 74, which goes through mounting holes 53, 58 and bolt 75 which runs through mounting holes 54, 59. After using the curved T-housings to join the two face frames to the support frame, installers may adjust the angle of the face frames up to 20 degrees from the support frame by loosening bolt 73 and turning the face frames toward desired directions. Once desired direction is reached, bolt 73 should be secured.

In the preferred embodiment the back side of the curved T-housing also contains mounting holes 76, and 77 to facilitate the attachment of a mounting pipe.

Figure 7:
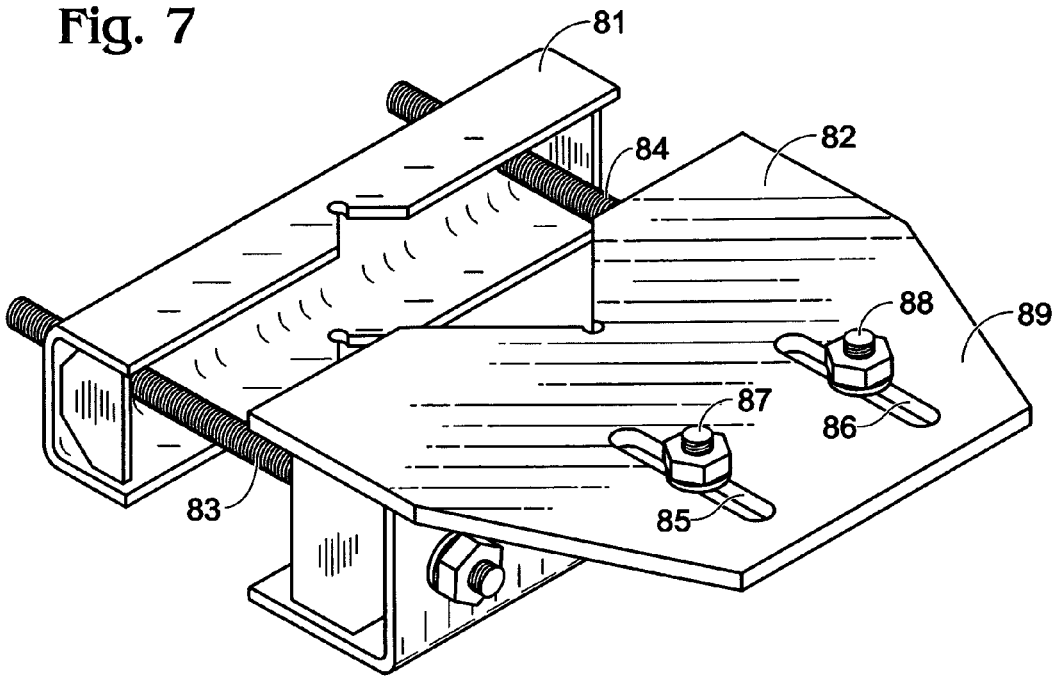
FIG. 7 shows an isometric view of the mounting bracket used to attach the support frame to the tower in accordance with one embodiment.

FIG. 7 shows an isometric view of the mounting bracket 80 which may be used to attach the support frame to a tower frame. The mounting bracket consist of a back side clamp 81 and a front side clamp 82 connected by two bolts 83 and 84. The tower frame should be positioned in between back side clamp 81 and front side clamp 82 and in between bolts 83 and 84 wherein the tightened bolts 83 and 84 would secure the mounting bracket unto the tower frame.

The front side clamp 82 consists of a protruding plate 89 with two elongated mounting holes 85 and 86. The first side of the support frame 10 can be attached to the protruding plate 89 by bolts 87, which goes through mounting holes 85, 17 and bolt 88, which runs through mounting holes 86, 18 (see FIG. 2 for position of mounting holes 17, 18).

The angle of the support frame in accordance to the tower frame can be adjusted by the position of both 87, 88 along the elongated mounting holes 85 and 86. This allows the embodiment to be parallel to the ground despite being mounted on a slanted tower frame.

Figure 8:
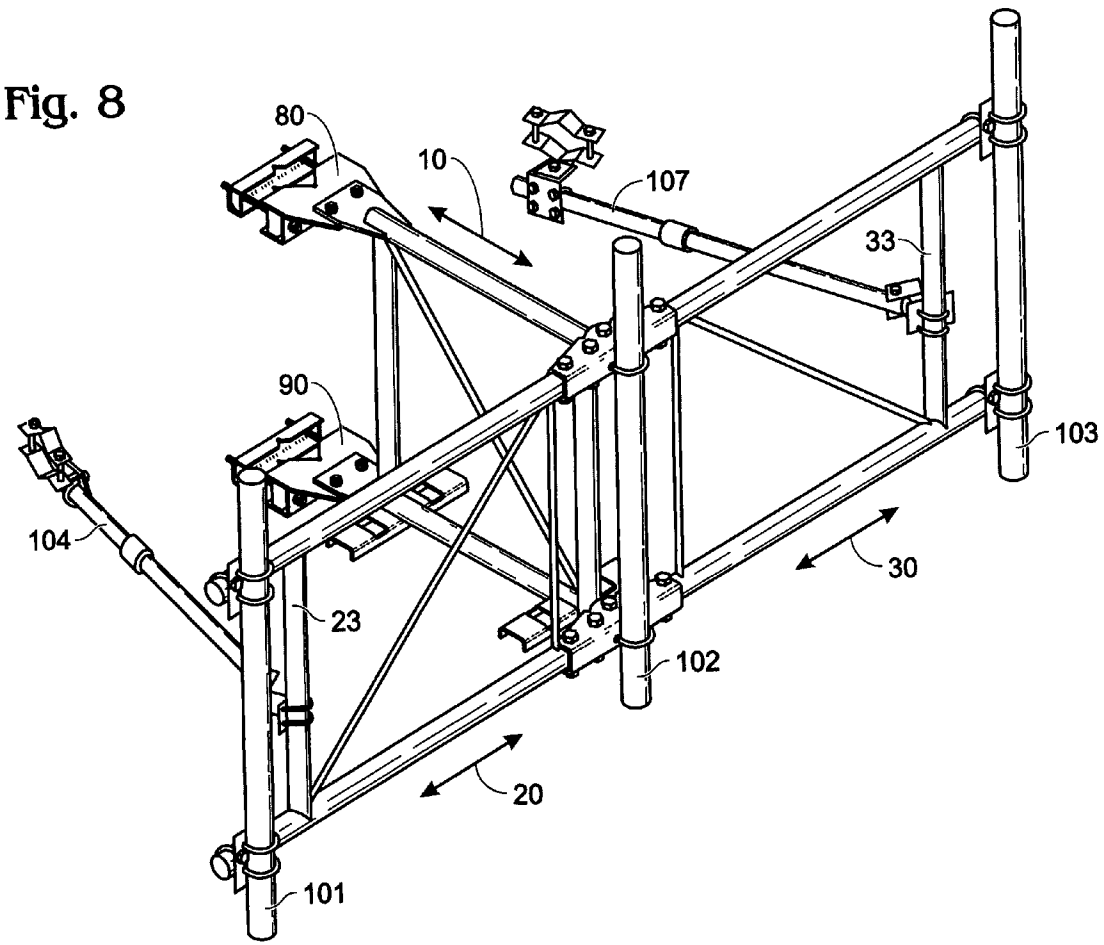
FIG. 8 shows an isometric view of the assembled Fast Set Antenna Frame in accordance with one embodiment.

FIG. 8 shows an isometric view of the assembled Fast Set Antenna Frame. Stiff arm kits 104, 107 consisting of two sides, wherein the first side can be attached to vertical frame 23, 33 on face frames, and second side can be attached to the tower.

Antenna mounting pipes 101 and 103 can by attached anywhere on the two horizontal frames on the face frame with any means known to a person skilled in the art. The center antenna mounting pipe 102 can be attached directly onto the curved T-housing by U bolts running through mounting holes 76, 77 (see FIG. 6)

FIG. 9 shows an isometric view of the assembly process to connect the face frames to the support frame. The second side of both horizontal frames on the face frame can be inserted into either side of the hollow cavity of the curved T-housing 40, 60 and secured by bolts 71, 72, 74, and 75 (see FIG. 6). The attachment of the face frames can be done one at a time on the tower itself once the support frame has already been secured onto the tower. The storage base on the lower horizontal frame of the support frame can be stood upon during the instillation process.

The benefits of the disclosed embodiment allows for a simple and economic way of mounting antennas onto preexisting structures including but not limited to all types of power towers.

Further benefits include the ability to ship and store the entire mounting system without taking up precious cargo or warehouse room.

Further benefits include the ability to install the support frame first without having to lift the entire frame onto the tower. The storage base located on the support frame not only acts as a storage device, but also can be used as a foot hold during the instillation process.

Throughout the specification the aim has been to describe the invention without limiting the invention to any one embodiment or specific collection of features. Persons skilled in the relevant art may realize variations from the specific embodiment that will nonetheless fall within the scope of the invention. For example, the entire frame can be mounted vertically, horizontally, or in any similar manner. The members of the face frame and the support frame need not be cylindrical. The means of securing the curved T-housing to the support frame and the face frames may be in any manner known in the art. The invention is not limited to only two face frames, but can include the use of a single face frame, or more than two face frames.

Accordingly, the scope of the invention should be determined not by the embodiment illustrated, but by the appended claims and their legal equivalents.

We claim:

1. A adjustable fast set antenna mounting frame comprising:

a. a support frame having a first vertical end, a second vertical end, a upper horizontal end, and a lower horizontal end, wherein the said first vertical end of said support frame may be connected to an at least one mounting bracket and the said second vertical end of said support frame is connected to an at least one curved T-housing and wherein the said lower horizontal end of the said support frame is connected to an at least one storage base;

b. an at least one face frame with a first vertical end and a second vertical end, wherein the said first end of the said an at least one face frame may be attached to the said curved T-housing.

2. The adjustable fast set antenna mounting frame of claim 1 wherein the said curved T-housing contains a upper side, lower side, a back side, and an open front side, wherein the outer edges of the said open front side are concaved.

3. The adjustable fast set antenna mounting frame of claim 2 where in the said back side of the said curved T-housing contains an at least two mounting holes.

4. The adjustable fast set antenna mounting frame of claim 1 wherein the said an at least one face frame further contains a cylindrical upper frame insertable into the said curved T-housing, and a cylindrical lower frame insertable into the said curved T-housing.

5. The adjustable fast set antenna mounting frame of claim 1 wherein the said at least one storage base contains an at least one storage grove.

6. The adjustable fast set antenna mounting frame of claim 1 wherein the said an at least one mounting bracket comprises of a back side clamp, a front side clamp, connected by an at least two bolts; wherein the said front side clamp further contains a protruding plate with an at least two elongated mounting holes.

* * * * *